US007472568B2

(12) United States Patent
Tang

(10) Patent No.: US 7,472,568 B2
(45) Date of Patent: Jan. 6, 2009

(54) PADLOCK WITH A QUICKLY CHANGEABLE SHACKLE AND PADLOCK WITH A FREELY CONVERTIBLE DEADLOCK MECHANISM

(75) Inventor: Xiong Wei Tang, Tortola (VG)

(73) Assignee: Trans Ocean Group Limited, Tortola (VG)

( * ) Notice: Subject to any disclaimer, the term of this patent is extended or adjusted under 35 U.S.C. 154(b) by 101 days.

(21) Appl. No.: 11/447,200

(22) Filed: Jun. 6, 2006

(65) Prior Publication Data

US 2007/0204664 A1 Sep. 6, 2007

(30) Foreign Application Priority Data

Mar. 2, 2006 (CN) ..... 2006 1 0058859

(51) Int. Cl.
*E05B 67/22* (2006.01)

(52) U.S. Cl. ..... 70/39; 70/26; 70/38 A; 70/53

(58) Field of Classification Search ..... 70/35, 70/38 A, 38 B, 38 C, 38 R, 39, 40, 53, 24–26
See application file for complete search history.

(56) References Cited

U.S. PATENT DOCUMENTS 957,033 A * 5/1910 de Bruycker ..... 70/38 A
1,622,999 A * 3/1927 Frith ..... 70/38 A
1,844,569 A * 2/1932 Fairchild ..... 70/38 C
1,849,070 A * 3/1932 Buehner ..... 70/38 C
4,158,952 A * 6/1979 Oliver et al. ..... 70/52
4,528,828 A * 7/1985 Poutiainen ..... 70/38 A
4,838,051 A * 6/1989 Yang ..... 70/38 A
6,766,673 B2 * 7/2004 Gast et al. ..... 70/38 A
2005/0061040 A1 * 3/2005 Gast et al. ..... 70/38 A

* cited by examiner

*Primary Examiner*—Patricia L Engle
*Assistant Examiner*—Christopher Boswell
(74) *Attorney, Agent, or Firm*—Rabin & Berdo, P.C.

(57) ABSTRACT

The invention provides a padlock with a quickly changeable shackle, comprising a locking core, a locking member, blocking balls, a lock body on which two limb receiving chambers and a passage are disposed, and a shackle which takes U-shape defined by a longer and a shorter parallel limbs respectively received in the limb receiving chambers to lock the padlock. A ring groove with an abutment head is disposed at the free end of the longer limb, and a depressed portion with a screw hole is provided on the circumferential surface of the abutment head. A shackle changing screw is threaded into the screw hole and the end face of the screw in the threaded position is higher than the depressed portion and lower than the circumferential surface of the abutment head. The invention further provides a padlock having a freely-convertible deadlock mechanism.

7 Claims, 8 Drawing Sheets

PADLOCK WITH A QUICKLY CHANGEABLE SHACKLE AND PADLOCK WITH A FREELY CONVERTIBLE DEADLOCK MECHANISM

FIELD OF THE INVENTION

The present invention relates to a lock device, and more particularly to a padlock with a quickly changeable shackle and a padlock with a freely convertible deadlock mechanism.

DESCRIPTION OF RELATED ART

A shackle of a padlock may need to be changed as a result of damage during usage and this is too hard to perform for commonly used padlocks. To effect the change of the shackle, a locking core of the padlock must be first removed from the lock body and some special tools are required to adjust related parts within the lock. It is not convenient and economical for a user as the whole process should be performed by a skilled locksmith. Improvements have been introduced to settle this problem. Referring now to FIGS. 1(*a*) and 1(*b*), a padlock comprises a lock body 10 and a shackle 11 having a groove 111 at its free end. The improvement lies in that a hole 101 is provided at the backside of the lock body 10 and positioned to align with the groove 111 when the shackle 11 is in unlocked status. A shackle changing screw 12 having an internal hexagon nut at its head is screwed into the hole 101. The shackle changing screw 12 is receivable in the groove 111 to block the shackle 11 from dropping out of the lock body 10 when the shackle 11 is in an unlocked status. The shackle changing screw 12 may be screwed off by a hexagon wrench to enable removal of the shackle 11 from the lock body 10, thus the change of the shackle 12 is effected. The above padlock has advantages including simple structure and easy manipulation of changing the shackle, but obviously suffers from some drawbacks. Specifically, the shackle changing screw 12 located in the hole 101 is in sight and may be removed when the padlock is in the locked status. With this removal of the shackle changing screw 12, the shackle 11 may be dropped out of the lock body 10 in the unlocked status to cause a breakdown of the padlock.

When the padlock is in the unlocked status, the key has two modes: one is the key may be freely taken out of the padlock, the other is the key may be confined in the padlock. The latter is called "deadlock mode". The former mode allows the key to be taken away by a user and it is easy for the key to become lost if the key itself is kept in the padlock. The latter mode allows the key to be consistently retained in the padlock and provides the inconvenience of taking the key away by a user. There exists a need for the user to convert the key between the deadlock mode and the non-deadlock mode when desirable. FIGS. 2(*a*) and 2(*b*) show a currently available padlock having a freely convertible deadlock mechanism, comprising a lock body 13 within which a locking core 15 and a locking member 16 is provided, and a shackle 14. This padlock has an improvement in providing a deadlock conversion block 17 as shown in FIG. 2(*c*). Change of the deadlock mode may be attained by taking the locking core 15 out in the unlocked status and taking the deadlock conversion block 17 off or putting the deadlock conversion block 17 on the region C of the locking member 16. The above padlock has advantages including a simple structure and easy manipulation of changing the key between the deadlock mode and the non-deadlock mode without the need of a skilled person, but suffers from the drawback that the deadlock conversion block 17 needs to be taken away in the non-deadlock mode and kept in a separate place. Once the deadlock conversion block is lost, the convertible deadlock mechanism will be disabled.

SUMMARY OF THE INVENTION

A padlock with a quickly changeable shackle and a padlock with a freely convertible deadlock mechanism are presented, which overcome the problems noted above and are safe and reliable to use.

According to one aspect of the invention, a padlock with a quickly changeable shackle comprises:

a lock body, within which a locking core, a locking member coupled to the locking core, and blocking balls are provided, and on which a deeper limb receiving chamber, a shallower limb receiving chamber and a passage in communication with the deeper limb receiving chamber are disposed; and a shackle, which takes U-shape defined by a longer parallel limb received in the deeper limb receiving chamber and a shorter parallel limb received in the shallower limb receiving chamber, wherein each of said two limbs is provided with a latching recess matched with the blocking ball, a ring groove with an abutment head is disposed at the free end of the longer limb, and wherein the longer limb is allowed to be turned and elevated in the deeper limb receiving chamber and the shorter limb is allowed to be elevated in and dropped out of the shallower limb receiving chamber when the padlock is in an unlocked status; the latching recesses on the longer and shorter limbs are respectively engaged with the blocking balls when the padlock is in a locked status; characterized in that a depressed portion is provided on the circumferential surface of the abutment head of the longer limb, on which there is a screw hole perpendicular to the depressed portion; a shackle changing screw is threaded into the screw hole and the end face of the screw in the threaded position is higher than the depressed portion and lower than the circumferential surface of the abutment head; the shackle changing screw is formed to have a shape and dimensions that allow the screw to pass through the passage on the lock body; and the screw hole is positioned such that the screw hole and the passage are in the same horizontal plane and reciprocally staggered when the padlock is in the unlocked status. Preferably, the passage is arranged in a position on the lock body where the lock body is aligned with a longitudinal central axis of the deeper limb receiving chamber.

Preferably, the passage is staggered with respect to the screw hole at an angle of 180° when the padlock is in the unlocked status.

Preferably, the passage is staggered with respect to the screw hole at an angle of 90° when the padlock is in the unlocked status.

Preferably, the shackle changing screw has an internal hexagon screw hole at its head.

In the padlock with a quickly changeable shackle of the invention, improvement is made in the position of the shackle changing screw, enabling this screw invisible and non-detachable during usage of the padlock so as thereby to provide advantages of safety and reliability as well as allowing quick change of the shackle by a simple operation.

According to another aspect of the invention, a padlock having a freely-convertible deadlock mechanism comprises:

a lock body, within which a locking core, a locking member coupled to the locking core, and blocking balls are provided, and on which a deeper limb receiving chamber and a shallower limb receiving chamber are disposed; and a shackle, which takes U-shape defined by a longer parallel limb received in the deeper limb receiving chamber and a shorter parallel limb received in the shallower limb receiving chamber, wherein each of said two limbs is provided with a latching recess matched with the blocking ball, and wherein the longer limb is allowed to be elevated in the deeper limb receiving chamber and the shorter limb is allowed to be elevated in and dropped out of the shallower limb receiving chamber when the padlock is in an unlocked status, and the latching recesses on the longer and shorter limbs are respectively engaged with the blocking balls when the padlock is in a locked status; characterized in that the locking core has two stoppers which correspond to the locking member and protrude from a coupling surface between the locking core and the locking member; the locking member includes a receiving portion which partly receives the blocking balls, and a coupling portion which is coupled to the stoppers and is located between the stoppers; and the locking core further comprises a deadlock conversion block wherein a first deadlock conversion block receiving chamber is disposed on one of the stoppers to fully receive the deadlock conversion block, and a second deadlock conversion block receiving chamber is disposed on the coupling surface of the locking core to receive the deadlock conversion block in a manner that the deadlock conversion block protrudes beyond the coupling surface of the locking core; the second deadlock conversion block receiving chamber is arranged in a position where one end of the coupling portion of the locking member is located between one of the stoppers and the second deadlock conversion block receiving chamber when the locking core is coupled to the locking member.

Preferably, the deadlock conversion block takes shape of a cylinder, cuboid, or cube.

The padlock having a freely-convertible deadlock mechanism offers the convenience of converting the deadlock mode due to the arrangement of two deadlock conversion block receiving chambers of different depths and the deadlock conversion block within the lock body. Since the deadlock conversion block is retained within the lock body regardless of the deadlock mode, it is difficult for the deadlock conversion block to become lost.

To have a better understanding of the invention reference is made to the following detailed description of the invention and embodiments thereof in conjunction with the accompanying drawings.

BRIEF DESCRIPTION OF THE DRAWINGS

FIG. 1(*b*) is a sectional view taken along line A-A of FIG. 1(*a*);

FIG. 2(*b*) is a sectional view taken along line A-A of FIG. 2(*a*);

FIG. 2(*c*) is a perspective view of a deadlock conversion block of the padlock shown in FIG. 2(*a*);

FIG. 3(*b*) is a sectional view taken along line A-A of FIG. 3(*a*);

FIG. 3(*c*) is a sectional view taken along line B-B of FIG. 3(*a*);

FIG. 4(*b*) is a sectional view taken along line A-A of FIG. 4(*a*);

FIG. 5(*b*) is a sectional view taken along line A-A of FIG. 5(*a*);

FIG. 5(*c*) is a sectional view taken along line B-B of FIG. 5(*a*);

FIG. 6(*b*) is a sectional view taken along line A-A of FIG. 6(*a*);

FIG. 6(*c*) is a sectional view taken along line B-B of FIG. 6(*a*);

FIG. 7(*b*) is a sectional view taken along line A-A of FIG. 7(*a*);

FIG. 7(*c*) is a sectional view taken along line B-B of FIG. 7(*a*);

FIG. 8(*b*) is a partial perspective view showing the deadlock conversion block 8 of FIG. 8(*a*) is received in the first deadlock conversion block chamber 321;

FIG. 10(*b*) is a sectional view taken along line A-A of FIG. 10(*a*);

FIG. 10(*c*) is a sectional view taken along line B-B of FIG. 10(*a*);

FIG. 11(*b*) is a sectional view taken along line A-A of FIG. 11(*a*);

FIG. 12(*b*) is a sectional view taken along line A-A of FIG. 12(*a*).

DETAILED DESCRIPTION OF THE PREFERRED EMBODIMENT

Figure 1A:
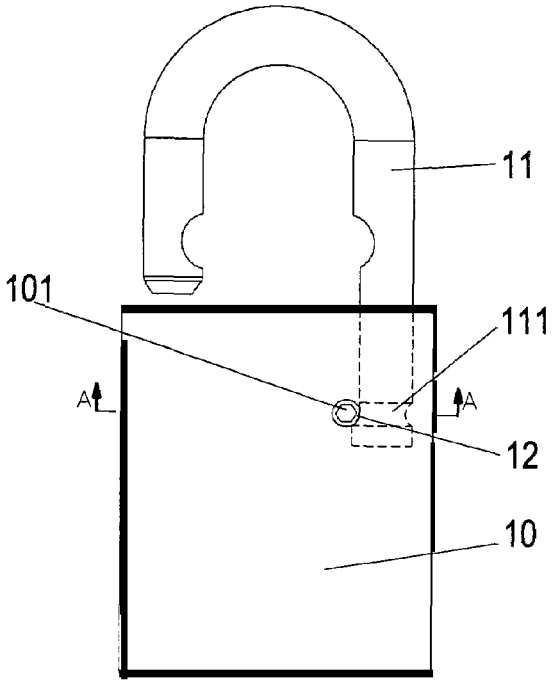
Fig. 1(a) PRIOR ART
FIG. 1(*a*) is a schematic view of a conventional padlock with a changeable shackle.
Figure 1B:
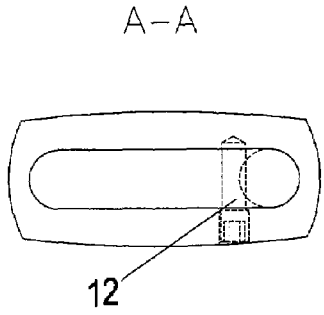
Fig. 1(b) PRIOR ART
Figure 2A:
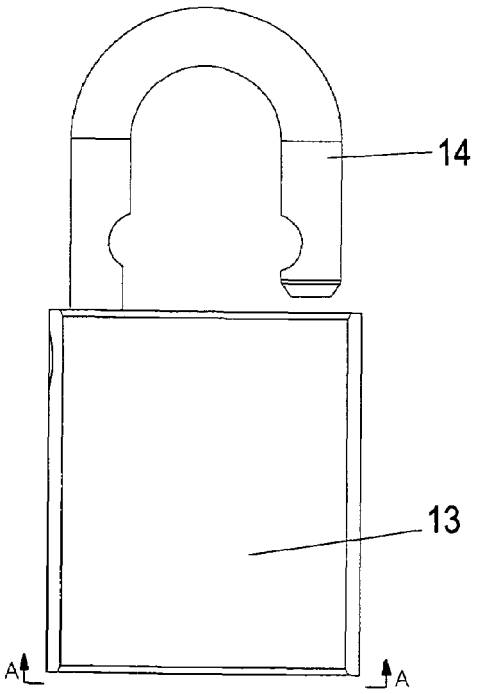
Fig. 2(a) PRIOR ART
FIG. 2(*a*) is a schematic view of a conventional padlock having a convertible deadlock mechanism.
Figure 2B:
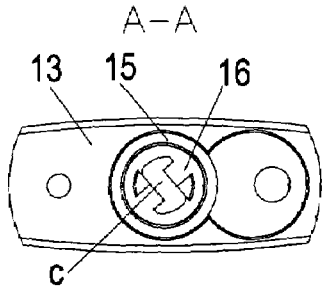
Fig. 2(b) PRIOR ART
Figure 2C:
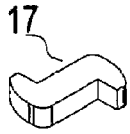
Fig. 2(c) PRIOR ART
Figure 3A:
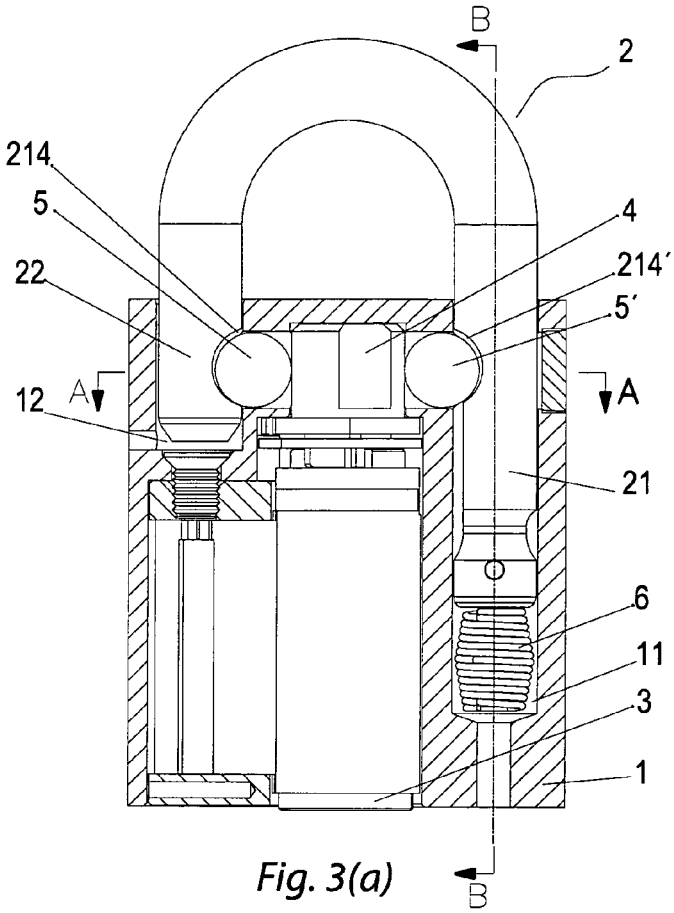
FIG. 3(*a*) is a vertical sectional view of a padlock with a quickly changeable shackle constructed consistent with a preferred embodiment of the invention showing the padlock is in locked status.
Figure 3C:
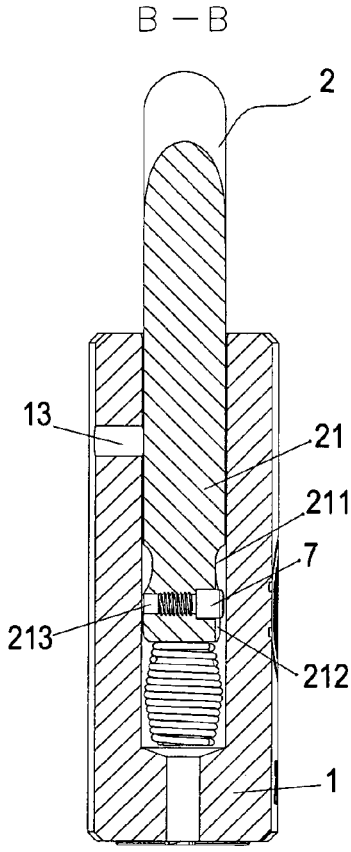
Figure 3B:
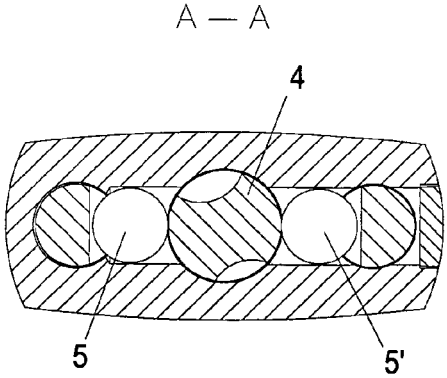

Referring now to the drawings, wherein the drawings are for purposes of illustrating preferred embodiments of the present invention only, and not for purposes of limiting the same. FIGS. 3(*a*) and 3(*b*) provide a padlock with a quickly changeable shackle consistent with a preferred embodiment of the present invention, showing the padlock is in a locked status. In this embodiment, the padlock with a quickly changeable shackle comprises a substantially rectangular lock body 1 made of metal, on which a cylindrical deeper limb receiving chamber 11 having an elastic member 6, and a cylindrical shallower limb receiving chamber 12 are disposed, and within which a locking core 3, a locking member 4 coupled to the locking core 3, and two blocking balls 5, 5' coupled to the locking member 4 are provided. This padlock further comprises a shackle 2, which makes a U-shape defined by a cylindrical longer parallel limb 21 received in the deeper limb receiving chamber 11 and a cylindrical shorter parallel limb 22 received in the shallower limb receiving chamber 12. The two limbs 21, 22 are respectively provided with a latching recess 214, 214' engageable with the blocking balls 5, 5'. The engagement of the latching recesses 214, 214' with the blocking balls 5, 5'enables locking of the padlock. The longer and shorter limbs 21, 22 are allowed to be elevated in the respective limb receiving chambers 11, 12. When the free end of the shorter limb 22 is dropped out of the shallower limb receiving chamber 12, the padlock is changed to its unlocked status where the longer limb 21 is capable of being turned within the deeper limb receiving chamber 11.

As shown in FIG. 3(*c*), the lock body 1 further has a passage 13 which vertically communicates with the deeper limb receiving chamber 11. Preferably, the passage 13 is arranged in a position on the lock body 1 where the lock body 1 is aligned with a longitudinal central axis (not shown) of the deeper limb 21 receivable in the deeper limb receiving chamber 11.

Figure 4A:
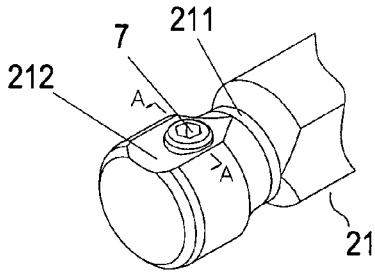
FIG. 4(*a*) is a perspective view showing the free end of the longer parallel limb 21 is received in the deeper limb receiving chamber.
Figure 4B:
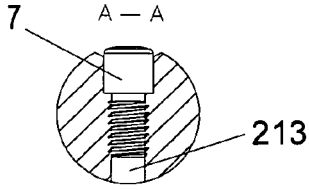

Referring to FIGS. 4(*a*) and 4(*b*), the longer limb 21 is provided at its free end with a ring groove 211 having an abutment head. A depressed portion 212 is arranged on the circumferential surface of the abutment head of the longer limb 21. On the depressed portion 212 there is a screw hole 213 perpendicular to the depressed portion. A shackle changing screw 7 having an internal hexagon screw hole at its head is threaded into the screw hole 213 and the end face of the screw 7 in the threaded position is higher than the depressed portion 212 and lower than the circumferential surface of the long limb 21. The shackle changing screw 7 is formed to have a shape and dimensions that allow the screw 7 to pass through the passage 13 on the lock body. The screw hole 213 is positioned such that the screw hole 213 and the passage 13 are in the same horizontal plane and and in alignment when the shackle 2 is elevated to unlock the padlock, with the head of the screw being positioned away from the passage 13, and the shaft of the screw being positioned near the passage 13, as shown in FIG. 5(*c*).

Figure 5A:
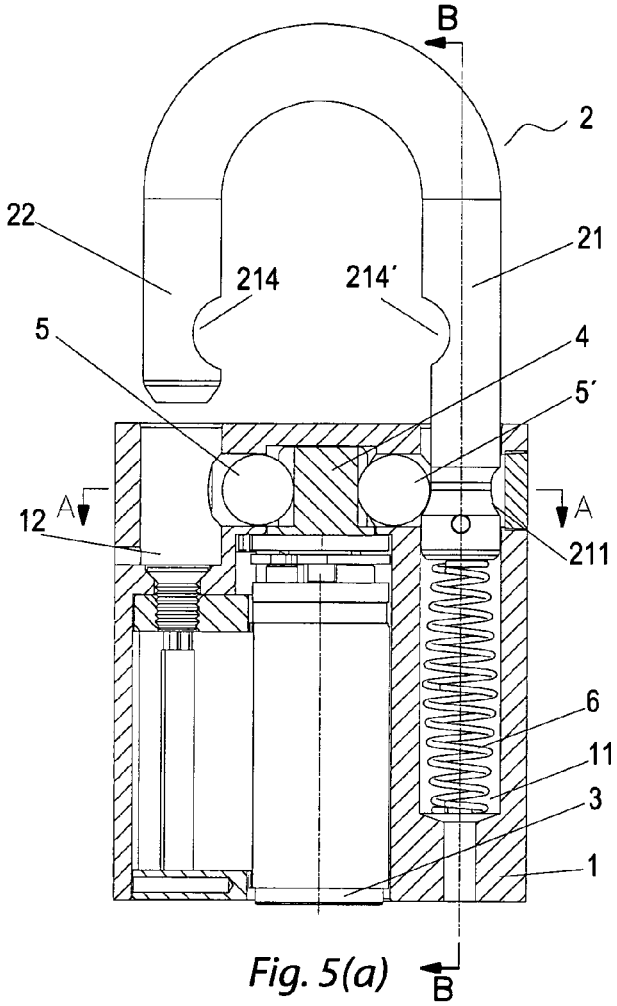
FIG. 5(*a*) is a vertical sectional view showing the padlock of FIG. 3(*a*) is in unlocked status.
Figure 5C:
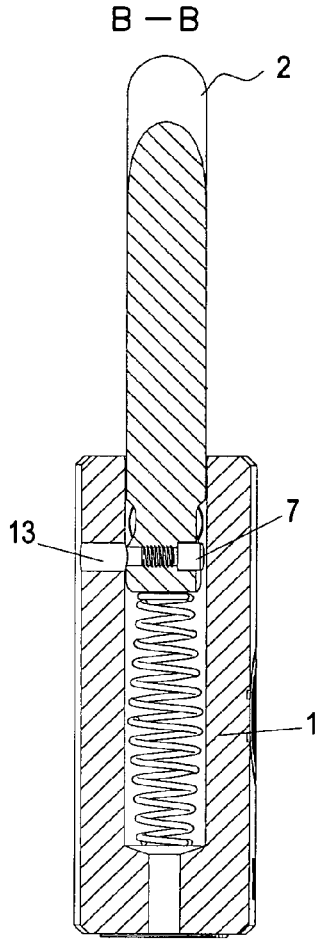
Figure 5B:
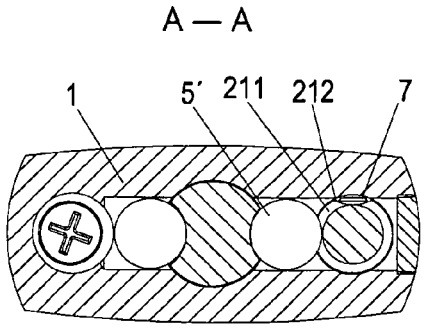

FIGS. 5(*a*) and 5(*b*) show the padlock is in the unlocked status. The locking member 4 is driven by the locking core 3 to turn and relocate to enable movement and relocation of the blocking balls 5, 5' towards an axis of the locking core 3 after being pressed by the circumferential surfaces of the two limbs 21, 22; at the same time the elastic member 6 applies an upward spring force to the longer limb 21 such that the latching recesses 214, 214' of the two limbs 21, 22 disengage from the blocking balls 5, 5' to be elevated till the free end of the shorter limb 22 is dropped out of the shallower limb receiving chamber 12. The padlock is thus in the locked status where the blocking ball 5' is engaged with the ring groove 211 at the end of the longer limb 21 and the shackle 2 is confined in the locking body 1 and therefore can not be changed due to the presence of the shackle changing screw 7 that protrudes beyond slightly the surface of the depressed portion 212, even if the longer limb 21 is turned within the deeper limb receiving chamber 11 to allow the depressed portion 212 to be in alignment with the blocking ball 5'. As best seen in FIG. 5(*c*), the head of the shackle changing screw 7 is hidden and kept out of sight from the passage 13, much less detached.

Figure 6A:
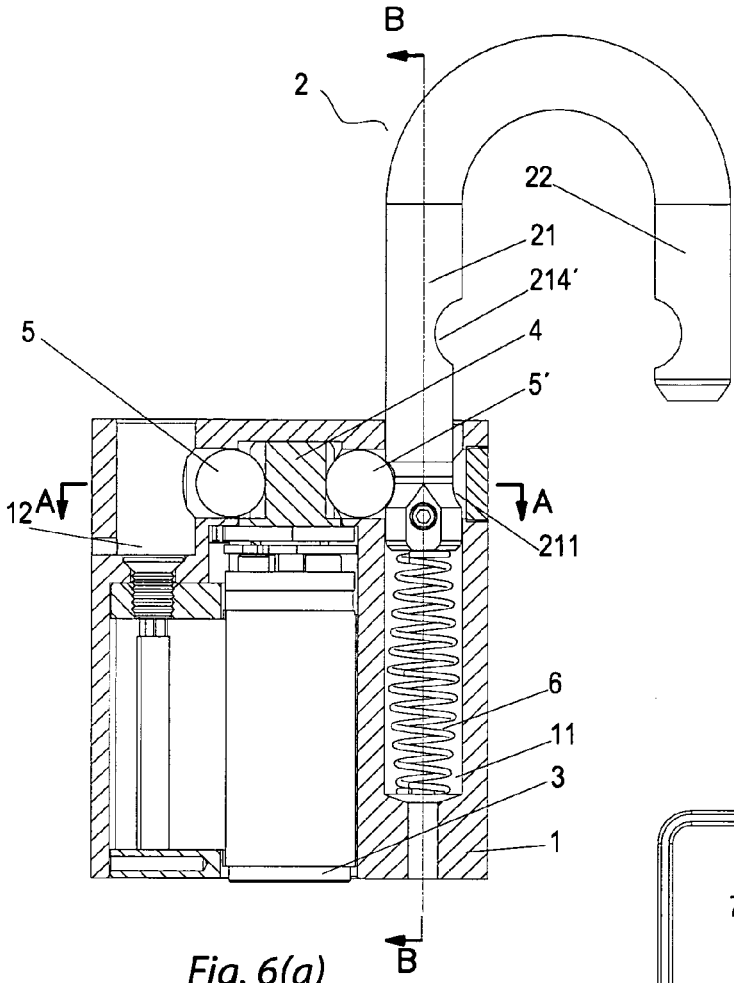
FIG. 6(*a*) is a vertical sectional view of the padlock of FIG. 5(*a*) showing the shackle 2 is rotated by 180°.
Figure 6B:
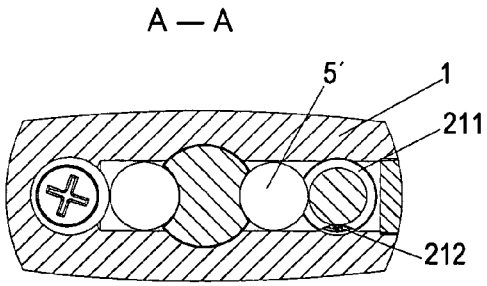
Figure 6C:
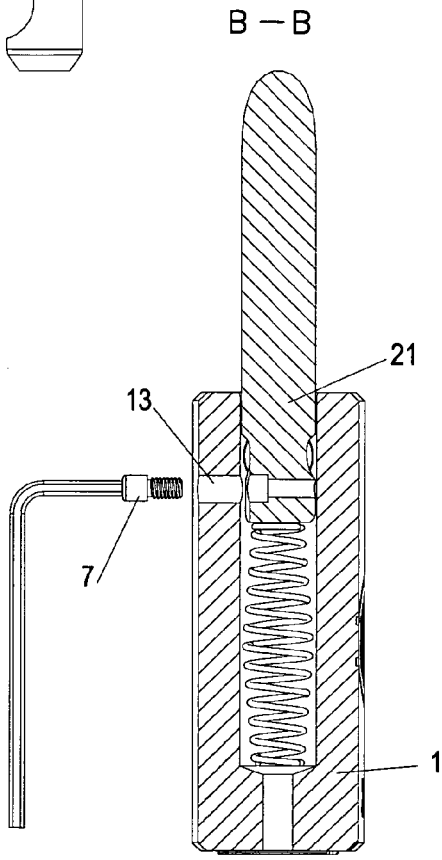

Since the screw hole 213 and the passage 13 on the lock body 1 are in the same horizontal plane and positionable to be in alignment in the unlocked status (FIGS. 6(*b*) and 6(*c*)), turning the shackle 2 allows the head of the shackle changing screw 7 to be exposed to the passage 13 when it is desirable to change the shackle 2. By use of an internal hexagon wrench, the screw 7 is easily screwed off the longer limb 21 of the shackle 2 and removed out from the passage 13. The shackle 2 is then turned to enable alignment of the depressed portion 212 at the end of the longer limb 21 with the blocking ball 5'. In this case, the blocking ball 5' runs through the depressed portion 212 without difficulty since the blocking action of the shackle changing screw 7 does not exist, with the result that the shackle 2 may be detached from the lock body 1. Change of a new shackle is attained by manipulating the steps of the operation process in a reversible manner.

In this embodiment, the screw hole 213 on the depressed portion 212 is positioned to offset by an angle of 180°with respect to the passage 13 on the lock body 1 when the padlock is in the locked status, therefore the shackle 2 is turned by 180°if removal of the shackle 2 is desirable. Also, such an angle may be 90°or the like, among which the angles of 90°or 180°providing the most convenience of aligning the head of the shackle changing screw with the passage 13 are preferred.

The head of the shackle changing screw 7 is provided at its head with an internal hexagon screw hole for facilitating access to the screw tool. As a result, the commonly used forms in the art catering for the head of the shackle changing screw may be employed, such as a straight slot with which a flat-head screwdriver is used or a conical slot with which a tapered-head screwdriver is used.

With the structures as described above, the padlock with a quickly changeable shackle of the invention offers the feature that the shackle changing screw is invisible and non-detachable during usage of the padlock so as to provide advantages of safety and reliability. The change of the shackle is attained by simply turning the shackle twice to the angles respectively necessary for removing the shackle changing screw and detaching the shackle from the lock body.

Figure 7A:
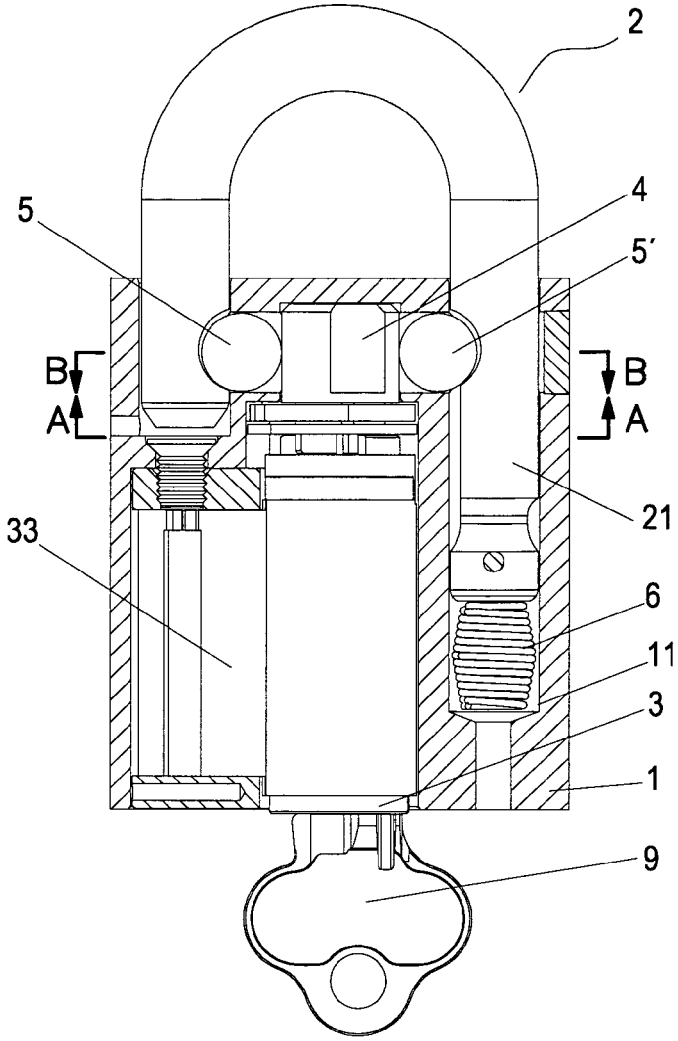
FIG. 7(*a*) is a vertical sectional view of a padlock having a freely-convertible deadlock mechanism constructed consistent with a preferred embodiment of the invention showing the padlock is in locked status.
Figure 7B:
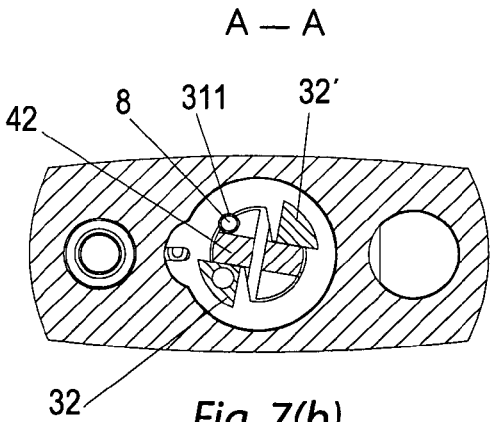
Figure 7C:
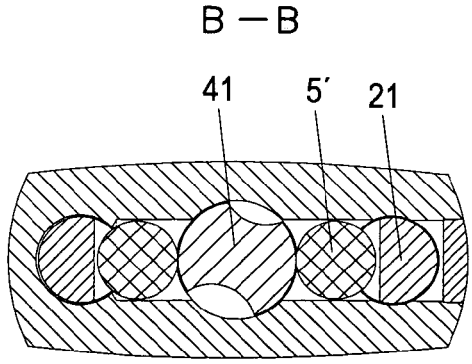
Figure 8A:
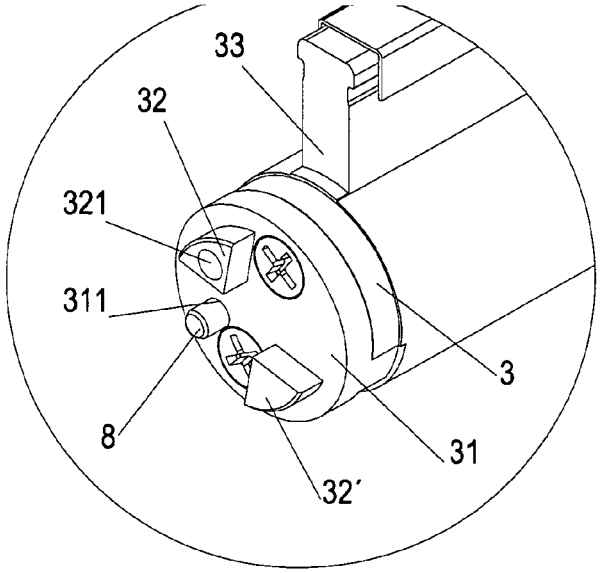
FIG. 8(*a*) is a partial perspective view showing the locking core 2 of the padlock of FIG. 7(*a*) is in a deadlock mode.
Figure 8B:
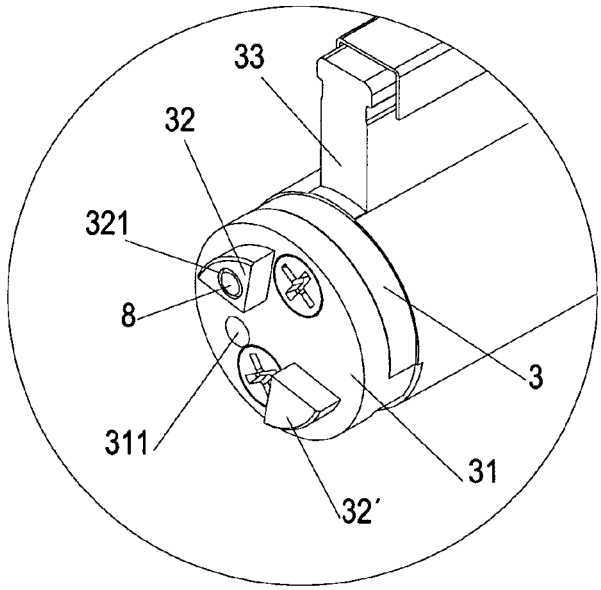
Figure 9:
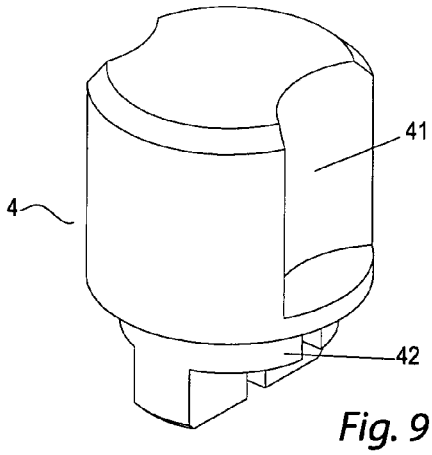
FIG. 9 is a perspective view of the locking member 4 of the padlock shown in FIG. 7(*a*)

Referring now to FIG. 7(*a*), a padlock with a freely convertible deadlock mechanism consistent with a preferred embodiment of the present invention is provided, showing the padlock is in a locked status. In this embodiment, the padlock comprises a lock body 1, a shackle 2, a locking core 3, a locking member 4 and two blocking balls 5, 5', wherein the locking core 3 may rotate relative to a locking cylinder 33 which is secured to the lock body 1 and acts with locking effect. A specified angle is defined by a key 9 and the locking cylinder 33 when the padlock is in the locked status and at this angle the key 9 may be freely taken out of the lock body 1. As shown in FIG. 8(*a*), the locking core 3 has two stoppers 32, 32' which correspond to the locking member 4 and protrude from a coupling surface 31 between the locking core 3 and the locking member 4. The locking member 4 includes a receiving portion 41 which partially receives the blocking balls 5, 5' and a coupling portion 42 which is coupled to the stoppers 32, 32' and is located between the stoppers 32, 32' (FIG. 9).

The locking core 3 further comprises a deadlock conversion block 8. A first deadlock conversion block receiving chamber 321 is disposed on the stopper 32 to fully receive the deadlock conversion block 8, and a second deadlock conversion block receiving chamber 311 is disposed on the coupling surface 31 of the locking core to receive the deadlock conversion block 8 in a manner that the deadlock conversion block 8 protrudes beyond the coupling surface 31. The second deadlock conversion block receiving chamber 311 is arranged in a position where one end of the coupling portion 42 of the locking member 4 is located between the stoppers 32, 32' and the second deadlock conversion block receiving chamber 311 when the coupling surface 31 is coupled to the coupling portion 42 of the locking member 4. In FIG. 7(*b*), the deadlock conversion block 8 is inserted into the second deadlock conversion block receiving chamber 311 to fasten the coupling portion 42 through clamping action applied by the stoppers 32, 32' and the deadlock conversion block 8. As a consequence, no room for movement between the locking member 4 and the locking core 3 is available. FIG. 7(*c*)

illustrates the position relationship between the blocking ball 5' and the receiving portion 41.

Figure 10A:
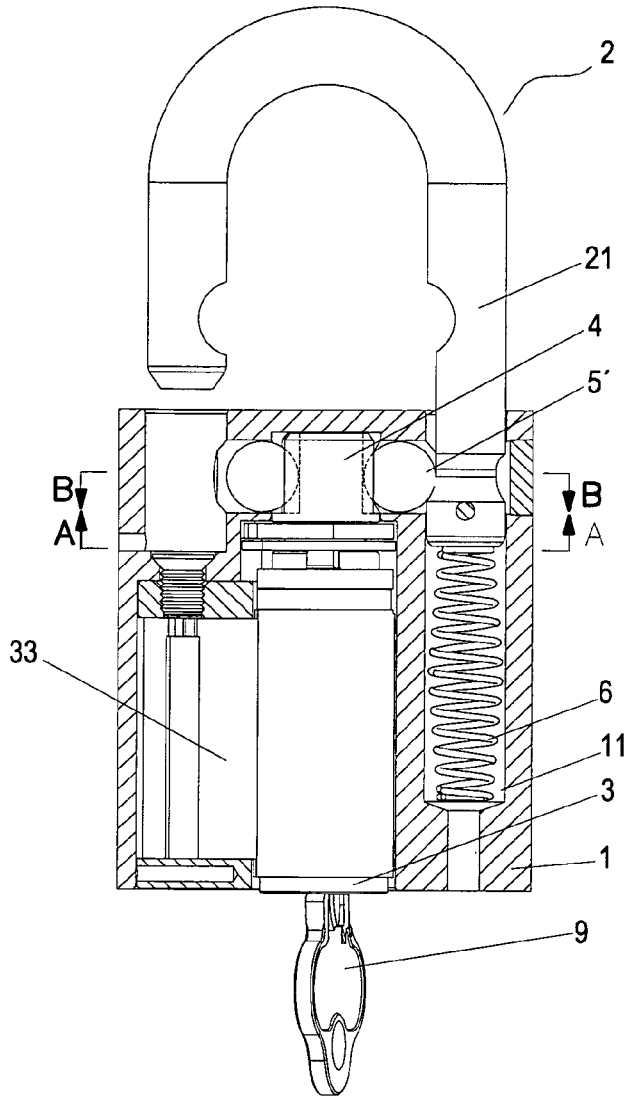
FIG. 10(*a*) is a vertical sectional view of the padlock of FIG. 7(*a*) showing the padlock is unlocked in a deadlock mode.
Figure 10B:
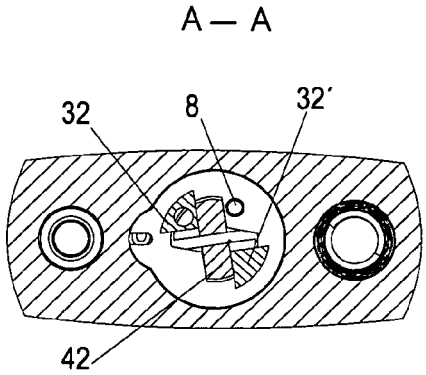
Figure 10C:
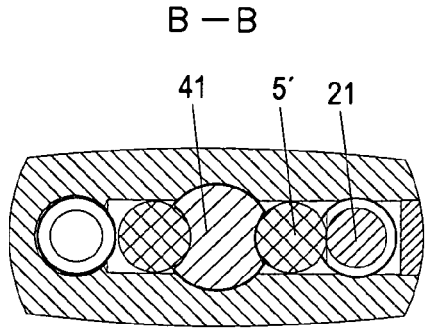

Referring to FIGS. 10(*a*) and 10(*b*), the padlock is unlocked by simply turning the key 9 together with the locking core 3 relative to the locking cylinder 33, the coupling portion 42 remains clamped by the stoppers 32, 32' and the deadlock conversion block 8 such that there is still no room for movement between the locking member 4 and the locking core 3. FIG. 10(*c*) illustrates the position relationship between the blocking ball 5' and the locking member 4. In this unlocked status of the padlock, the blocking balls 5, 5' are pressed by the outer circumferential surfaces of the limbs 21, 22 to retract and relocate back to the receiving portion 41 in axial direction of the locking core 3, in the result of locking the blocking balls 5, 5'. This locking action is indirectly applied to the key 9 through the receiving portion 41, the coupling portion 42, the stoppers 32, 32' and the locking core 3. As a consequence, the key 9 is fixed and can not be turned back to the position where the key 9 lies at the specified angle to the locking cylinder 33 as shown in FIG. 7(*a*). The key 9 is thus fixedly kept in the lock body 1 and the padlock is in a deadlock mode. In other words, the deadlock conversion block 8 acts to transfer the locking action of the blocking balls 5, 5' to the key 9 through the locking member 4 and the locking core 3 so as to effect no restoration of the key 9.

When it is desirable to convert the padlock into a non-deadlock mode, the deadlock conversion block 8 is taken out of the second deadlock conversion block receiving chamber 311 and then inserted into the first deadlock conversion block receiving chamber 321 upon removing the locking core 3 from the lock body 1 (FIG. 8(*b*)). The deadlock conversion block 8 is fully hidden in the first deadlock conversion block receiving chamber 321 which has the depth different from that of the second deadlock conversion block receiving chamber 311, followed by placing the locking core 3 illustrated in FIG. 8(*b*) into the lock body 1. The padlock is then in a non-deadlock mode.

Figure 11A:
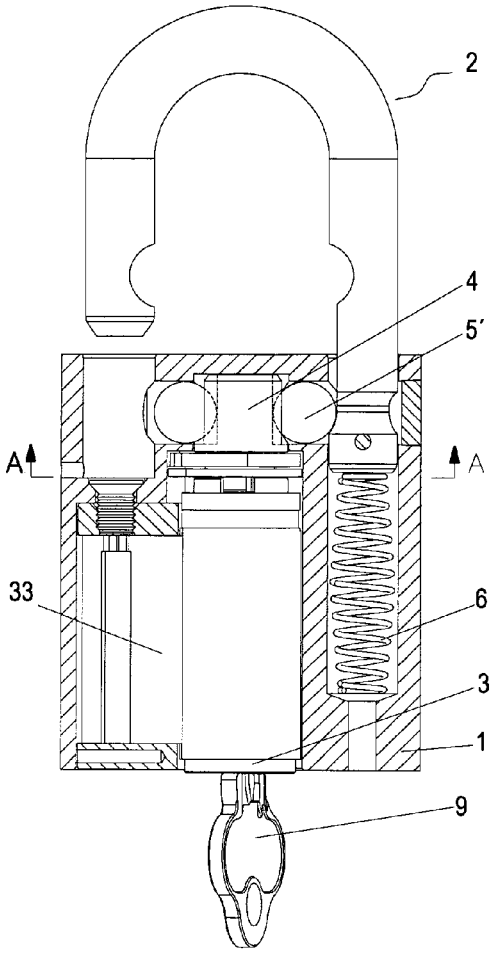
FIG. 11(*a*) is vertical sectional view of the padlock of FIG. 7(*a*) showing the padlock is unlocked in a non-deadlock mode.
Figure 12A:
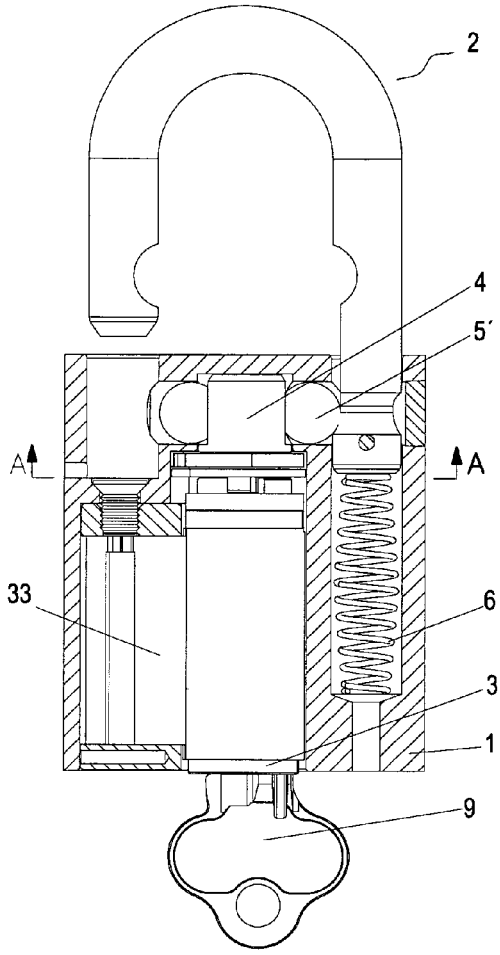
FIG. 12(*a*) is a vertical sectional view of the padlock of FIG. 11(*a*) when the key 9 is turned back.
Figure 11B:
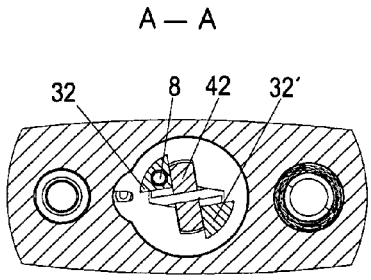
Figure 12B:
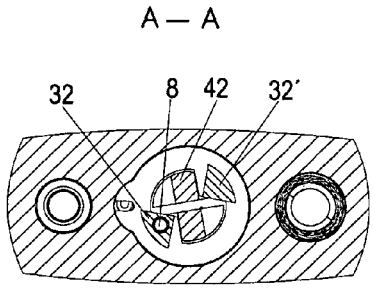

Referring in particular to the FIGS. 11(*a*) and 11(*b*), after the padlock is unlocked by causing the key 9 to turn together with the locking core 3 relative to the locking cylinder 33, the coupling portion 42 is clamped by the stoppers 32,32' only to allow some room for relative movement between the locking member 4 and the locking core 3, because the deadlock conversion block 8 is hidden in the first deadlock conversion block receiving chamber 321 of the stopper 32. In this situation, the locking action of the blocking balls 5, 5' can not be indirectly applied to the key 9 through the locking member 4 and the locking core 3. As a consequence, the blocking balls and the locking member 4 are locked, while the locking core 3 may be turned with respect to the locking member 4 back to the specified angle as shown in FIG. 7(*a*). This is best seen in FIGS. 12(*a*) and 12(*b*). The key 9 may be removed from the lock body 1 and the padlock is in a non-deadlock mode.

According to the invention, the deadlock conversion block 8 may take shape of a cylinder, a cuboid, a cube and the like. Accordingly, the deadlock conversion block receiving chambers 311, 321 are shaped to receive the deadlock conversion block 8 in a relatively loose manner. The stoppers 32, 32' are formed in shape of a quarter of cylinder in the above embodiment and may also take triangular shape or other shapes that cooperate with the coupling portion 42.

The padlock having a freely-convertible deadlock mechanism of the invention provides the two deadlock conversion block receiving chambers of different depths, which allows a user to convert the padlock between the deadlock mode and the non-deadlock mode without the need of a skilled person and a specialized tool. Since the deadlock conversion block 8 is retained within the lock body 1 regardless of the deadlock mode, it is difficult for the deadlock conversion block 8 to become lost.

It is understood that many other embodiments of the inventions are also possible, and many corresponding modifications as well as variations can be made by those skills in the art according to the disclosure of the present application and without departing from the spirits and essentials thereof, while such modifications and variations fall into the scope of the claims of the present application.

What is claimed is:

1. A padlock with a quickly changeable shackle comprising:

a lock body, within which a locking core, a locking member coupled to the locking core, and blocking balls are provided, and on which a deeper limb receiving chamber, a shallower limb receiving chamber and a passage in communication with the deeper limb receiving chamber are disposed; and a shackle, which has a U-shape defined by a longer parallel limb received in the deeper limb receiving chamber and a shorter parallel limb received in the shallower limb receiving chamber, wherein each of said two limbs is provided with a latching recess matchable with a respective blocking ball, a ring groove with an abutment head is disposed at a free end of the longer limb, and wherein the longer limb is allowed to be turned and elevated in the deeper limb receiving chamber and the shorter limb is allowed to be elevated in and removed out of the shallower limb receiving chamber when the padlock is in an unlocked status, and the latching recesses on the longer and shorter limbs are respectively engaged with the blocking balls when the padlock is in a locked status; characterized in that a depressed portion is provided on a circumferential surface of the abutment head of the longer limb, on which there is a screw hole perpendicular to the depressed portion; a shackle changing screw is threaded into the screw hole and an end face of the screw in the threaded position projects from a base of the depressed portion but is recessed with respect to the circumferential surface of the abutment head; the shackle changing screw is formed to have a shape and dimensions that allow the screw to pass through the passage on the lock body; and the screw hole is positionable such that the screw hole and the passage are in the same horizontal plane but are not normally aligned with each other when the padlock is in the unlocked status, except when the shackle is to be changed.

2. The padlock as claimed in claim 1, characterized in that the passage is arranged in a position on the lock body where the lock body is aligned with a longitudinal central axis of the deeper limb receiving chamber.

3. The padlock as claimed in claim 2, characterized in that the passage is staggered with respect to the screw hole at an angle of 180° when the padlock is in the unlocked status.

4. The padlock as claimed in claim 2, characterized in that the passage is staggered with respect to the screw hole at an angle of 90° when the padlock is in the unlocked status.

5. The padlock as claimed in claim 1, characterized in that the passage is staggered with respect to the screw hole at an angle of 180° when the padlock is in the unlocked status.

6. The padlock as claimed in claim 1, characterized in that the passage is staggered with respect to the screw hole at an angle of 90° when the padlock is in the unlocked status.

7. The padlock as claimed in claim 1, characterized in that the shackle changing screw has an internal hexagon screw hole at its head.

* * * * *